US011197586B2

(12) United States Patent
Huang et al.

(10) Patent No.: US 11,197,586 B2
(45) Date of Patent: Dec. 14, 2021

(54) BUILT-IN SEATING FOR A SPA

(71) Applicant: BESTWAY INFLATABLES & MATERIAL CORP., Shanghai (CN)

(72) Inventors: Shuiyong Huang, Shanghai (CN); Jing Wan, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 38 days.

(21) Appl. No.: 16/610,804

(22) PCT Filed: May 4, 2017

(86) PCT No.: PCT/CN2017/082994

§ 371 (c)(1),
(2) Date: Nov. 4, 2019

(87) PCT Pub. No.: WO2018/201373

PCT Pub. Date: Nov. 8, 2018

(65) Prior Publication Data

US 2020/0060481 A1 Feb. 27, 2020

(51) Int. Cl.

| | |
|---|---|
| ***A47K 3/12*** | (2006.01) |
| ***A61H 33/02*** | (2006.01) |
| ***A47K 3/022*** | (2006.01) |
| ***A61H 33/00*** | (2006.01) |

(52) U.S. Cl.

CPC ..... *A47K 3/122* (2013.01); *A47K 3/022* (2013.01); *A61H 33/02* (2013.01); *A61H 33/6021* (2013.01); *A61H 2203/02* (2013.01); *A61H 2203/0425* (2013.01); *A61H 2203/0443* (2013.01)

(58) Field of Classification Search

CPC ..... A47K 3/122; E04H 4/0025; E04H 4/14; A61H 33/025; A47C 4/54

See application file for complete search history.

(56) References Cited

U.S. PATENT DOCUMENTS

| | | | | |
|---|---|---|---|---|
| 5,020,168 A | | 6/1991 | Wood | |
| 5,135,440 A | * | 8/1992 | Smollar | A63G 31/007 472/128 |
| 5,190,350 A | * | 3/1993 | Hwang | A47C 1/143 297/226 |

(Continued)

FOREIGN PATENT DOCUMENTS

| | | |
|---|---|---|
| CH | 708184 | 12/2014 |
| DE | 4111365 A1 | 2/1992 |
| JP | 2015066154 A | 4/2015 |

OTHER PUBLICATIONS

Extended European Search Report dated Mar. 23, 2021 (Mar. 23, 2021) issued on related European Patent Application 17908701.0 by the European Patent Office.

*Primary Examiner* — Janie M Loeppke
(74) *Attorney, Agent, or Firm* — Dickinson Wright PLLC

(57) ABSTRACT

A spa (100) with built-in seating is disclosed. The spa (100) includes a pool body (10) partially enclosing a water cavity (11), and a seating assembly (20). The seating assembly (20) includes an inflatable bench (23) attached to a floor of the pool body (10), and an inflatable backrest (25) attached to the inflatable bench (23) by at least one attachment assembly (31) having an adjustable length such that a user can adjust a position of the inflatable backrest (25) relative to the inflatable bench (23).

21 Claims, 6 Drawing Sheets

(56) References Cited

U.S. PATENT DOCUMENTS

| | | | | |
|---|---|---|---|---|
| 5,307,529 | A * | 5/1994 | Wang | A61H 33/025 4/541.5 |
| 5,560,056 | A * | 10/1996 | Tai | A45F 3/22 297/118 |
| 6,357,061 | B1 * | 3/2002 | Gonzalez | A47K 3/12 4/580 |
| 6,595,861 | B1 * | 7/2003 | Morrow | E04H 4/0025 4/488 |
| 7,152,256 | B1 * | 12/2006 | Roberts | A47K 3/002 4/583 |
| 2002/0120983 | A1 | 9/2002 | Gonzalez | |
| 2009/0090751 | A1 | 4/2009 | D'Alessandro | |
| 2012/0233766 | A1 | 9/2012 | Homan | |
| 2015/0351564 | A1 * | 12/2015 | Vogel | A47G 9/1081 5/640 |

* cited by examiner

BUILT-IN SEATING FOR A SPA

CROSS-REFERENCE TO RELATED APPLICATION

This application is a 35 U.S.C. § 371 national stage application of PCT Application Ser. No. PCT/CN2017/082994, filed on May 4, 2017, which is hereby incorporated by reference in its entirety and for which priority is claimed for the present application.

BACKGROUND

A spa, or hot tub, is a free-standing pool containing warm or hot water in which one or more people can partially immerse themselves. Some spas have built-in, inflatable seating; and, in some cases, the entire spa can be inflatable. Typical inflatable seating can be integrally formed to an air chamber of an inflatable spa; however, users may not be able to adjust the seating to their comfort or desired height above water level.

SUMMARY

At least one aspect is directed to a spa with built-in seating. The spa includes a pool body partially enclosing a water cavity and a seating assembly. The seating assembly includes an inflatable bench attached to a floor of the pool body and an inflatable backrest attached to the inflatable bench by at least one attachment assembly having an adjustable length such that a user can adjust a position of the inflatable backrest relative to the inflatable bench.

In some implementations, the attachment assembly includes a loop attached to the inflatable bench; a belt comprising a first end portion, a middle portion, and a second end portion; a reception part of a buckle attached to a first end of the first end portion; a point of connection attaching a second end of the first end portion and a first end of the middle portion to the inflatable backrest; and an insertion part having slot through which the middle portion enters and the end portion emerges. The slot provides friction against slippage of the belt through the insertion part. The insertion part and the middle portion are passed through the loop and the insertion part is inserted into the reception part to fasten the attachment assembly. A length of the second end portion can be pulled through the slot to shorten a length of the attachment assembly.

In some implementations, the inflatable backrest is attached to the inflatable bench by at least three attachment assemblies, each attachment assembly having an adjustable length.

In some implementations, a first attachment assembly adjustably connects a lower portion of the inflatable backrest to the inflatable bench, a second attachment assembly adjustably connects a first side of a top portion of the inflatable backrest to the inflatable bench and a third attachment assembly adjustably connects a second side of the top portion opposite the first side to the inflatable bench.

In some implementations, the inflatable backrest is removably attached to the inflatable bench, and the inflatable backrest can be attached at either end of the inflatable bench.

In some implementations, the inflatable backrest is separately inflatable from the inflatable bench.

In some implementations, the spa includes an inflatable stool assembly attached to the floor of the pool body.

In some implementations, the spa includes an air chamber having a plurality of holes configured to release bubbles into water filling the water cavity.

At least one aspect is directed to a spa with built-in seating. The spa includes a pool body partially enclosing a water cavity and a seating assembly. The seating assembly includes an inflatable bench attached to a floor of the pool body and an inflatable backrest attached to the inflatable bench by at least one attachment member or assembly having an adjustable length such that a user can adjust a position of the inflatable backrest relative to the inflatable bench.

In some implementations, the inflatable backrest is attached to the inflatable bench by at least three attachment members, each attachment member having an adjustable length.

In some implementations, a first attachment member adjustably connects a lower portion of the inflatable backrest to the inflatable bench, a second attachment member adjustably connects a first side of a top portion of the inflatable backrest to the inflatable bench, and a third attachment member adjustably connects a second side of the top portion opposite the first side to the inflatable bench.

These and other aspects and implementations are discussed in detail below. The foregoing information and the following detailed description include illustrative examples of various aspects and implementations, and provide an overview or framework for understanding the nature and character of the claimed aspects and implementations. The drawings provide illustration and a further understanding of the various aspects and implementations, and are incorporated in and constitute a part of this specification.

BRIEF DESCRIPTION OF THE DRAWINGS

The above-mentioned and other features, properties and advantages of the present invention will become more apparent from the following description of embodiments with reference to the accompanying drawings, in which.

DETAILED DESCRIPTION

The present invention will be further described below in conjunction with detailed embodiments and the accompanying drawings. More details are provided in the following detailed description in order for the present invention to be fully understood. However, the present invention can be implemented in various ways other than those described herein. A person skilled in the art can make similar analogy and modification according to the practical applications without departing from the spirit of the present invention, and therefore the contents of the detailed embodiments herein should not be construed as limiting to the scope of the present invention.

FIGS. 1-6 illustrate an example implementation of an inflatable spa according to the teachings of the present disclosure. These drawings are used as examples, are not necessarily drawn to scale, and should not be construed as limiting the scope of the disclosure.

Figure 1:
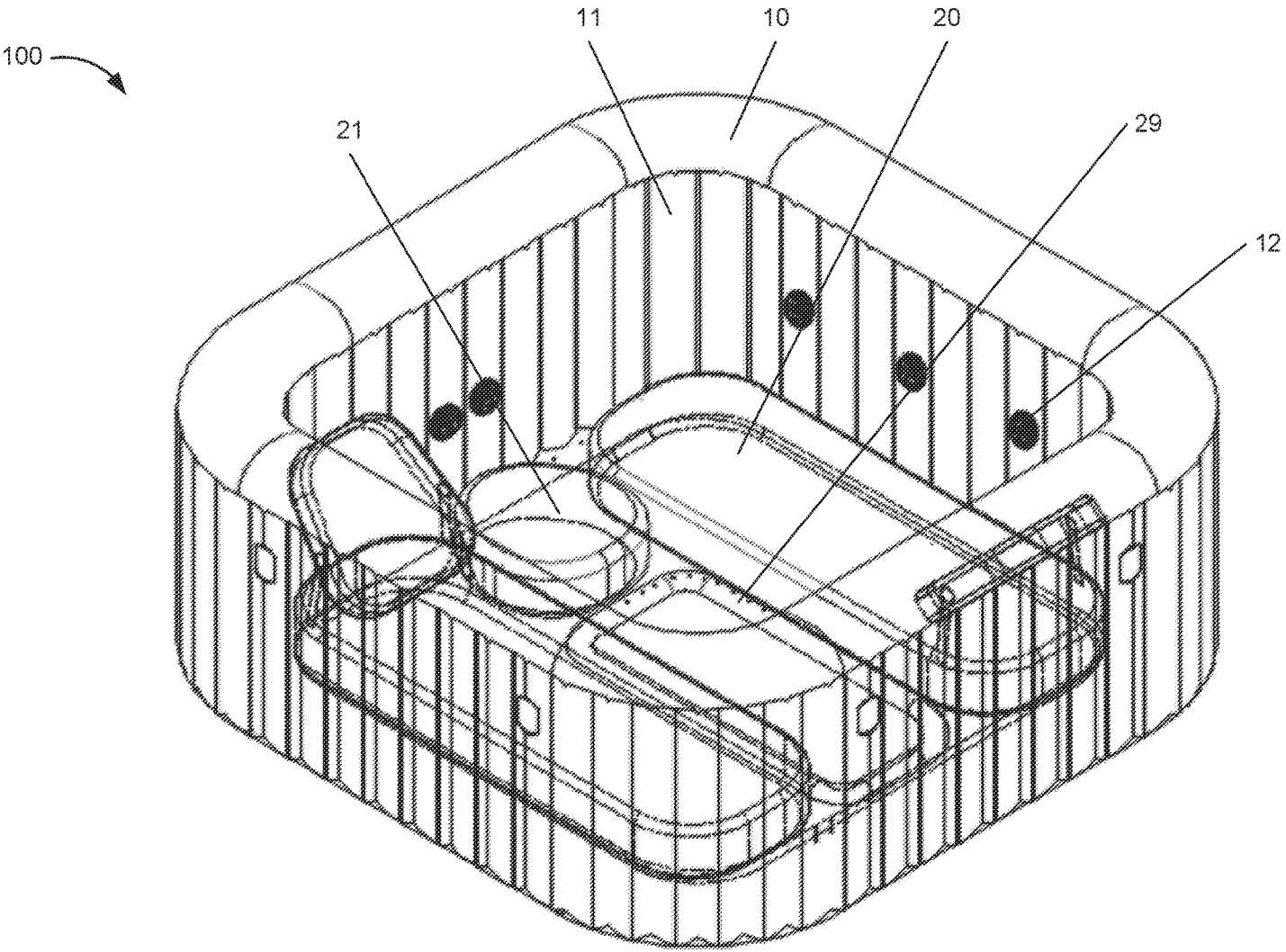
FIG. 1 illustrates a perspective view of an inflatable spa, according to an illustrative implementation.

FIG. 1 illustrates a perspective view of an inflatable spa 100, according to an illustrative implementation. The inflatable spa 100 includes a pool body 10 partially enclosing a water cavity 11. The inflatable spa 100 includes one or more built-in seating assemblies 20 and one or more built-in inflatable stools 21. The inflatable spa 100 also includes one or more air jets 12 and an air delivery chamber 29. The air jets 12 and air delivery chamber 29 can release bubbles into water in the water cavity 11.

Figure 2:
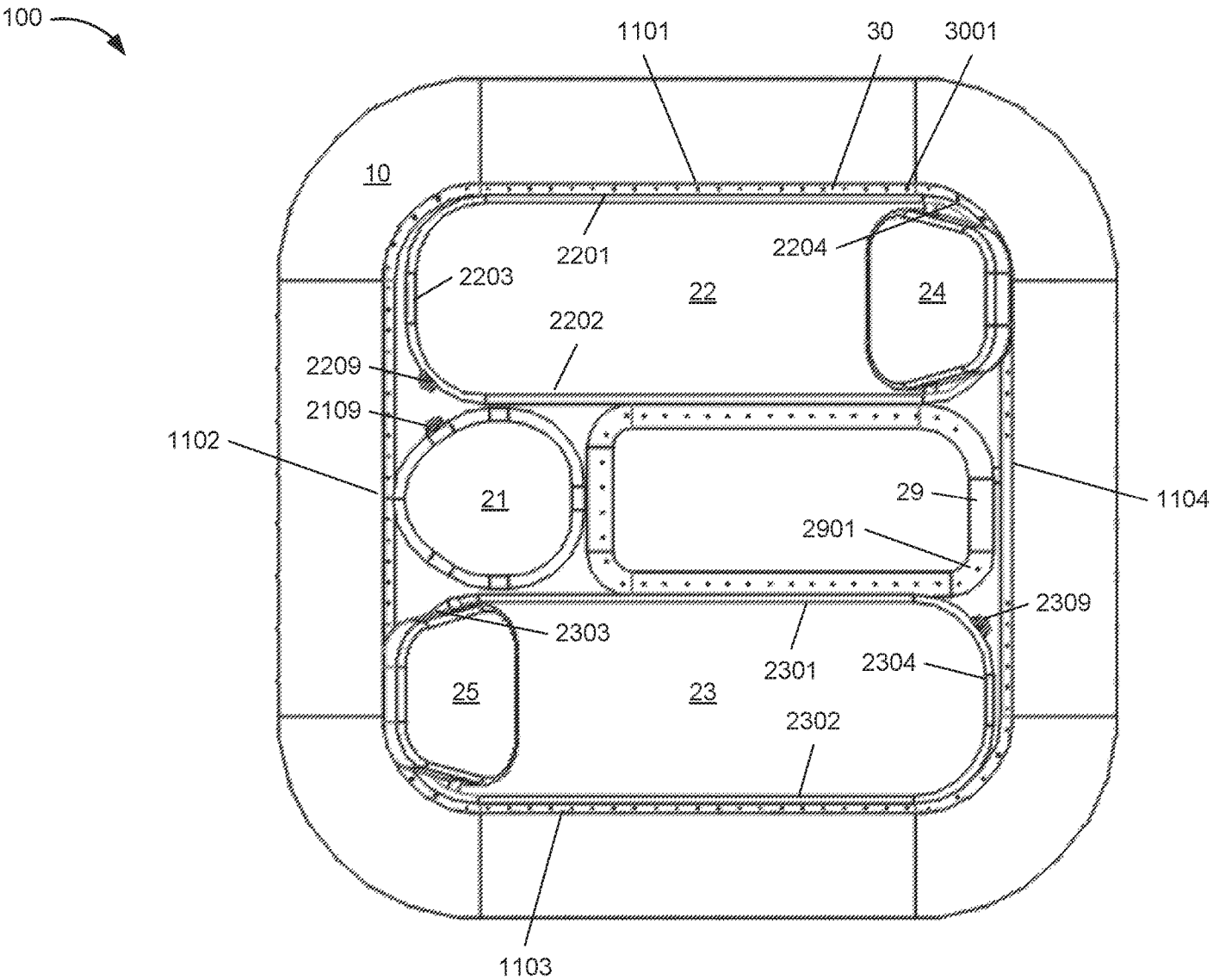
FIG. 2 illustrates a top view of an inflatable spa, according to an illustrative implementation.

FIG. 2 illustrates a top view of the inflatable spa 100, according to an illustrative implementation. The pool body 10 encloses the water cavity 11, as illustrated in FIG. 1. The pool body 10 is substantially square or rectangular, and can have rounded or chamfered corners on the inside (water cavity 11 side) and the outside. The pool body 10 can be an inflatable assembly made of a flexible material including one or more of a polymer, rubber, or textile. When inflated to a pressure greater than that of the surrounding atmosphere, the pool body 10 can have sufficient structural integrity such that its walls stand upright and retain water in the water cavity 11. The water cavity 11 can have a substantially square or rectangular bottom coinciding with a floor of the pool body 10. The bottom of the water cavity 11 has four sides including a first bottom side 1101, a second bottom side 1102, a third bottom side 1103, and a fourth bottom side 1104. The first bottom side 1101 is opposite the third bottom side 1103, and the second bottom side 1102 is opposite the fourth bottom side 1104.

The seating assemblies 20 include a first inflatable backrest 24 attached to a first inflatable bench 22, and second inflatable backrest 25 attached to a second inflatable bench 23. The first inflatable bench 22 has a first long side 2201, a second long side 2202, a first short side 2203, and a second short side 2204. The first long side 2201 is adjacent to the first bottom side 1101, the first short side 2203 is adjacent to the second bottom side 1102, and the second short side 2204 is adjacent to the fourth bottom side 1104. When filled with air, the first inflatable bench 22 can support a person sitting or lying thereon when the water cavity 11 is full of water. The first inflatable bench 22 can be filled with air via a valve 2209. In some implementations, the first inflatable bench 22 can have an opening in a bottom wall that allows communication of air to and from the pool body 10. The first inflatable backrest 24 can be tabular in shape. The first inflatable backrest 24 can be attached to the first inflatable bench 22 and positioned adjacent to one end, such as the second short side 2204. In some implementations, the first inflatable backrest 24 can be removably attached at either end of the first inflatable bench 22. When the first inflatable backrest 24 is filled with air, and the water cavity 11 is filled with water, the buoyancy of the first inflatable backrest 24 can support a person sitting, lying, or leaning thereon.

The second inflatable bench 23 and the second inflatable backrest 25 can be similar or identical to the first inflatable bench 22 and the first inflatable backrest 24. In particular, the second inflatable bench 23 has a first long side 2301, a second long side 2302, a first short side 2303, and a second short side 2304. The second long side 2302 is adjacent to the third bottom side 1103, the first short side 2303 is adjacent to the second bottom side 1102, and the second short side 2204 is adjacent to the fourth bottom side 1104. When filled with air, the second inflatable bench 23 can support a person sitting or lying thereon when the water cavity 11 is full of water. The second inflatable bench 23 can be filled with air via a valve 2309. In some implementations, the second inflatable bench 23 can have an opening in a bottom wall that allows communication of air to and from the pool body 10. The second inflatable backrest 25 can be tabular in shape. The second inflatable backrest 25 can be attached to the second inflatable bench 23 and positioned adjacent to one end, such as the second short side 2304. In some implementations, the second inflatable backrest 25 can be removably attached at either end of the second inflatable bench 23. When the second inflatable backrest 25 is filled with air, and the water cavity 11 is filled with water, the buoyancy of the second inflatable backrest 25 can support a person sitting, lying, or leaning thereon.

The first inflatable backrest 24 and the second inflatable backrest 25 can include features that allow for adjustment of the position of the of the inflatable backrests 24 and 25. These adjustment features are discussed in detail below with regard to FIGS. 4-6.

The inflatable stool 21 is positioned between the first inflatable bench 22 and the second inflatable bench 23. When filled with air, the inflatable stool 21 can support a person sitting thereon. The first inflatable stool 21 can be filled with air via a valve 2109. In some implementations, the inflatable stool 21 can have an opening in a bottom wall that allows communication of air to and from the pool body 10.

The air delivery chamber 29 includes a tube or hose formed on, or attached to, the floor of the pool body 10. The air delivery chamber 29 can be positioned adjacent to the fourth bottom side 1104 of the pool body 10, a side of inflatable stool 21, the second long side 2202 of the first inflatable bench 22, and the first long side 2301 of the second inflatable bench 23. The air delivery chamber 29 includes a plurality of air delivery holes 2901. An air pump can pump air into the air delivery chamber such that it escapes from the air delivery holes 2901 to release bubbles into the water in the water cavity 11. The bubbles can provide massaging stimulation to users immersed in the water.

In some implementations, the inflatable spa 100 can include an air delivery chamber 30 along a perimeter of the bottom of the water cavity 11. The air delivery chamber 30 can include a tube or hose adjacent to the bottom sides 1101, 1102, 1103, and 1104 of the water cavity 11. The air delivery chamber 30 includes a plurality of air delivery holes 3001. An air pump can pump air into the air delivery chamber such that it escapes from the air delivery holes 3001 to release bubbles into the water in the water cavity 11.

Figure 3:
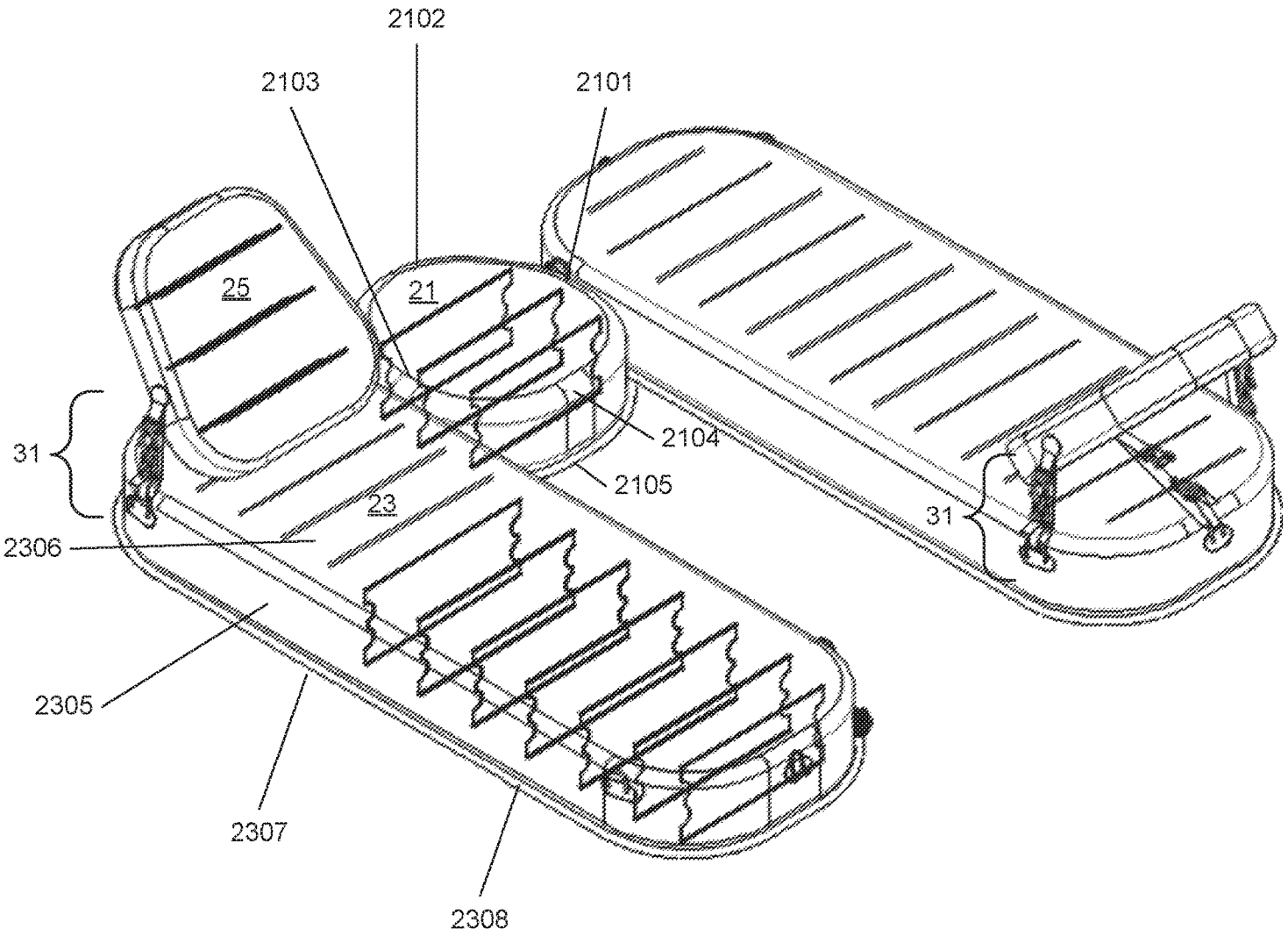
FIG. 3 illustrates a perspective view of built-in seating assemblies and an inflatable stool, according to an illustrative implementation.

FIG. 3 illustrates a perspective view of built-in seating assemblies 20 and an inflatable stool 21, according to an illustrative implementation. The inflatable stool 21 can be round, elliptical, or polygonal, with our without chamfered or rounded corners. The inflatable stool 21 has four sides including a first end 2101, a second end 2102, a third end 2103, and a fourth end 2104. The inflatable stool 21 can be positioned within the pool body 10 such that the first end 2101 is adjacent to the second long side 2202 of the first inflatable bench 22, the second end 2102 is adjacent to the second bottom side 1102, the third end 2103 is adjacent to the first long side 2301 of the second inflatable bench 23, and the fourth end 2104 is adjacent to the air delivery chamber 29. The inflatable stool 21 includes a margin 2105 around its base. The margin 2105 can be welded or otherwise bonded to the floor of the pool body 10.

The inflatable bench 23 can have a sidewall 2305, a top wall 2306, and a bottom wall 2307. The bottom wall 2307 includes a margin 2308. In some implementations, the length of the bottom wall 2307 can be larger than the length of the top wall 2306. The margin 2308 can be welded or otherwise bonded to the floor of the pool body 10.

The second inflatable backrest 25 is attached to the second inflatable bench 23 by one or more adjustable attachment assemblies 31. The attachment assemblies 31 facilitate positioning of the second inflatable backrest 25 with respect to the second inflatable bench 23. The second inflatable backrest 25 and the attachment assemblies 31 are described in detail below with regard to FIGS. 4-6.

Figure 4:
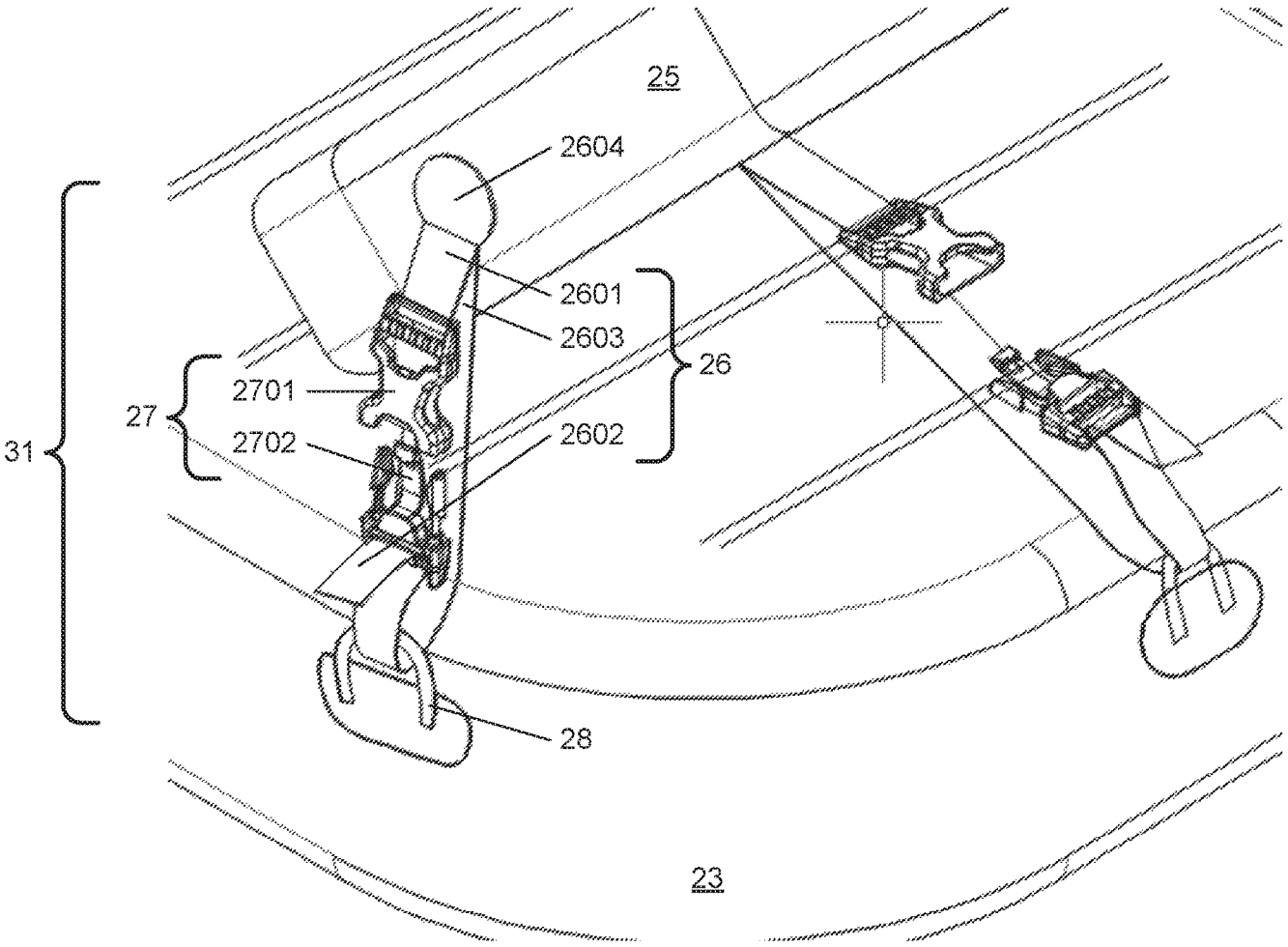
FIG. 4 shows an adjustable attachment assembly for attaching an inflatable backrest to an inflatable bench, according to an illustrative implementation.

FIG. 4 shows an adjustable attachment assembly 31 for attaching an inflatable backrest 25 to an inflatable bench 23, according to an illustrative implementation. The attachment assembly 31 includes a belt 26, a buckle 27, a loop 28, and a point of connection 2604. The attachment assembly 31 creates an attachment between the point of connection 2604 and the loop 28 that is adjustable in length. The belt 26 includes a first end portion 2601, a second end portion 2602, and a middle portion 2603. The buckle 27 includes a reception part 2701 and an insertion part 2702. The middle portion 2603 and the second end portion 2602 can feed through one or more slots in the insertion part 2702. The slots can provide friction against the belt 26 to prevent slippage of the belt 26 through the insertion part 2702. When the reception part 2701 and the insertion part 2702 are buckled, the attachment assembly 31 will restrain the inflatable backrest 25, and counteract the effect of buoyancy pulling the inflatable backrest 25 up and away from the inflatable bench 23. The user can pull the second end portion 2602 through the slots in the insertion part 2702 to shorten the middle portion 2603 and thus the distance between the point of connection 2604 and the loop 28. In this manner, the attachment assembly 31 can be shortened or lengthened to adjust the position and orientation of the inflatable backrest 25 with respect to the inflatable bench 23.

In some implementations, the inflatable bench 23 can include one or more loops 28 at either end of the inflatable bench 23 (i.e., the end adjacent to the first short side 2303 and the end adjacent to the second short side 2304). This can allow the inflatable backrest 25 to be positioned at either end of the inflatable bent 23 as desired. In some implementations, the built-in seating assembly 20 can include more than one attachment assembly 31. In some implementations, the loop 28 and the point of connection 2604 can be reversed such that the point of connection 2604 is on the inflatable bench 23 and the loop is on the inflatable backrest 25. In some implementations, the built-in seating assembly 20 can include three attachment assemblies 31, as shown in FIG. 5.

Figure 5:
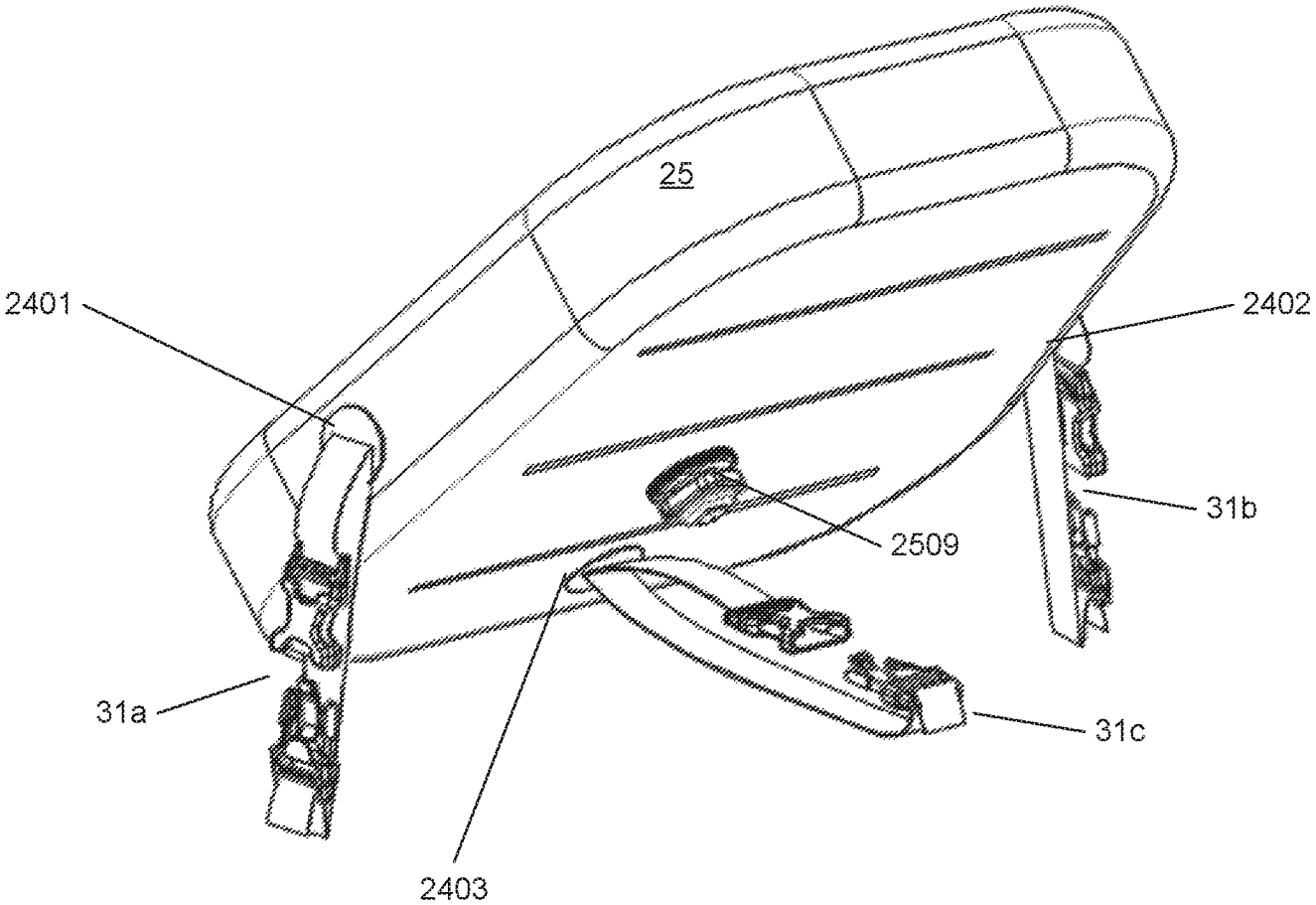
FIG. 5 illustrates a perspective view of an adjustable inflatable backrest, according to an illustrative implementation.

FIG. 5 illustrates a perspective view of an adjustable inflatable backrest 25, according to an illustrative implementation. In the implementations illustrated in FIG. 5, the inflatable backrest 25 is restrained by three attachment assemblies 31*a*, 31*b*, and 31*c* (collectively "attachment assemblies 31"). The attachment assemblies 31*a*, 31*b*, and 31*c* are attached to the inflatable backrest 25 via a first point of connection 2401, a second point of connection 2402, and a third point of connection 2403, respectively. The attachment assemblies 31*a*, 31*b*, and 31*c* are attached to the inflatable bench 23 by loops 28, as shown previously in FIG. 4. The inflatable backrest 25 can be filled with air via a valve 2509. When the water cavity 11 is full of water and the inflatable backrest 25 is full of air, buoyancy will push the inflatable backrest 25 upwards, and the attachment assemblies 31 will restrain it. The user can adjust position and angle of the inflatable backrest 25 as desired by adjusting the length of each attachment assembly 31. Thus, the user can place the inflatable backrest 25 in a position of maximum comfort for relaxing in the spa.

In some implementations, more or fewer attachment assemblies may be used to restrain the inflatable backrest 25. In some implementations, the inflatable backrest 25 can be completely removable from the inflatable bench 23. In some implementations, a bottom edge of the inflatable backrest 25 may include a margin appropriate for welding to the top wall 2306 of the inflatable bench 23. In some implementations, the attachment assemblies 31 can comprise other means for retaining the inflatable backrest 25; for example, hook and loop fasteners, a frame-style or plate-style buckle, or a cam buckle.

Figure 6:
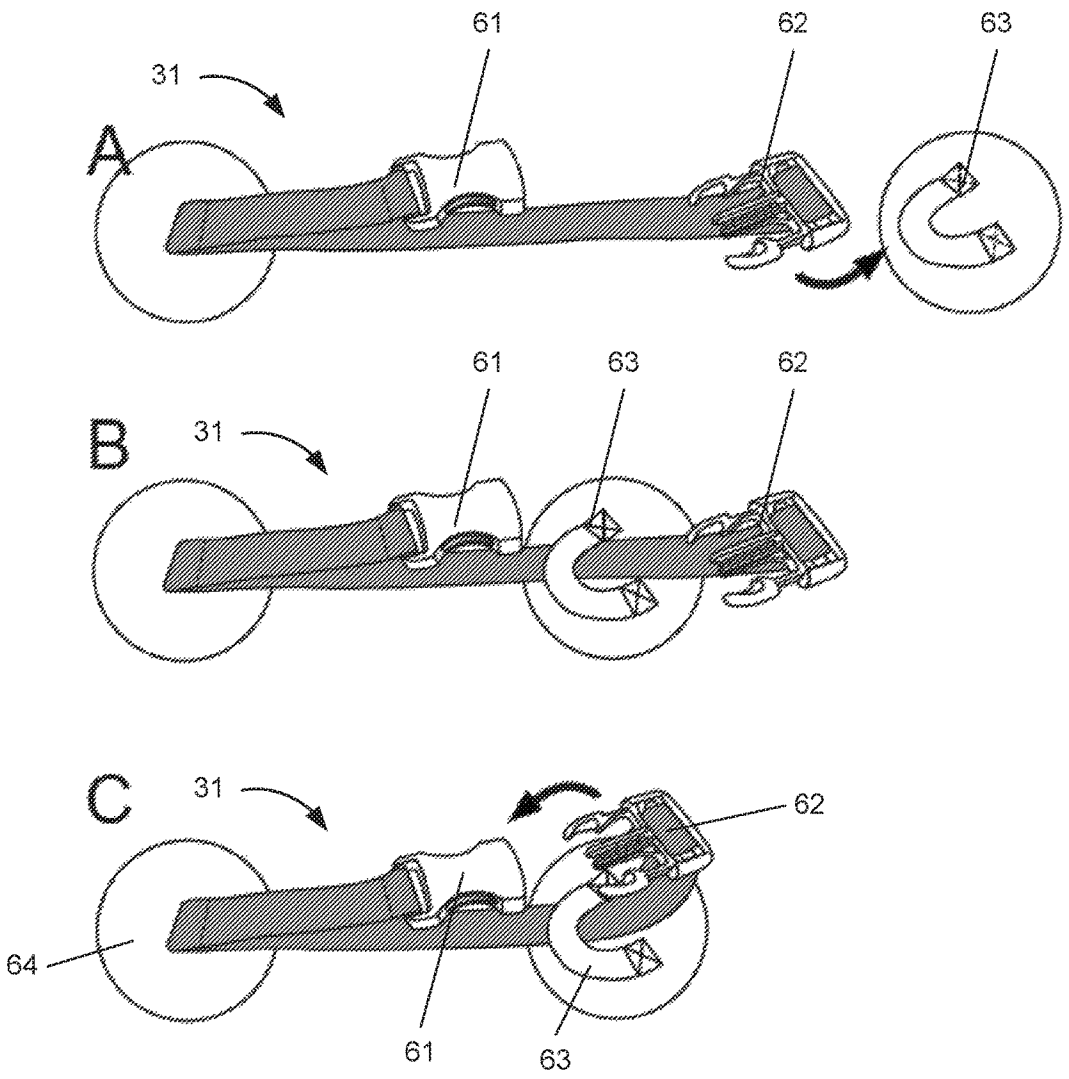
FIG. 6 illustrates operation of an adjustable attachment assembly, according to an illustrative implementation.

FIG. 6 illustrates operation of an adjustable attachment assembly 31, according to an illustrative implementation. The attachment assembly 31 includes a reception part 61, an insertion part 62, and a loop 63. The operation includes three stages, A, B, and C.

In stage A, the reception part 61 and the insertion part 62 are disengaged. The insertion part 62 and belt are free of the loop 63.

In stage B, the insertion part 62 and belt are passed through the loop 63.

In stage C, the insertion part 62 is brought back around for insertion into the reception part 61. When the reception part 61 and the insertion part 62 are engaged, the attachment assembly 31 can restrain the inflatable backrest 24 or 25. The distance between the loop 63 and a point of connection 64 can be adjusted by sliding the belt through the slots of the insertion part 62, as previously described with regard to FIG. 4. The user can thus adjust the inflatable backrest 24 or 25 to the desired position and orientation with respect to the inflatable bench 22 or 23.

The present invention has been described above in connection with example implementations which, however, are not intended to be limiting to the scope of the present invention, and any person skilled in the art could make possible changes and modifications without departing from the spirit and scope of the present invention. Hence, any alteration, equivalent change and modification which are made to the above-mentioned examples in accordance with the technical substance of the present invention and without departing from the spirit of the present invention, would fall within the scope defined by the claims of the present invention.

What is claimed is:

1. A spa, comprising;

a pool body; and a seating assembly comprising:

an inflatable bench attached to a floor of the pool body, an inflatable backrest, and at least one attachment assembly detachably coupling the inflatable backrest to the inflatable bench, the at least one attachment assembly having an adjustable length such that a position of the inflatable backrest relative to the inflatable bench is adjustable and determined based on a combination of a buoyancy of the inflatable backrest and the adjustable length of the at least one attachment assembly.

2. The spa of claim 1, wherein the at least one attachment assembly comprises a first attachment assembly, a second attachment assembly, and a third attachment assembly, each of the first, second, and third attachment assemblies having an adjustable length.

3. The spa of claim 2, wherein:

the first attachment assembly connects a lower portion of the inflatable backrest to the inflatable bench;

the second attachment assembly connects a first side of a top portion of the inflatable backrest to the inflatable bench; and the third attachment assembly connects a second side of the top portion opposite the first side to the inflatable bench.

4. The spa of claim 1, wherein:

the inflatable backrest is detachably couplable, via the at least one attachment assembly to one of a first end of the inflatable bench and a second end of the inflatable bench.

5. The spa of claim 1, wherein the inflatable backrest is separately inflatable from the inflatable bench.

6. The spa of claim 1, further comprising an inflatable stool assembly attached to the floor of the pool body.

7. The spa of claim 1, further comprising an air chamber having a plurality of holes configured to release bubbles into water filling the water cavity.

8. A spa, comprising:

a pool body; and a seating assembly comprising:

an inflatable bench attached to a floor of the pool body, an inflatable backrest, and at least one attachment assembly detachably coupling the inflatable backrest to the inflatable bench, the at least one attachment assembly having an adjustable length such that a position of the inflatable backrest relative to the inflatable bench adjustable, the at least one attachment assembly comprising:

a loop attached to the inflatable bench;

a belt configured to pass through the loop;

a reception part of a buckle attached to a first end of the belt;

a point of connection attaching the inflatable backrest to a connection point of the belt between the first end of the belt and a second end of the belt, opposite the first end; and an insertion part of the buckle comprising a slot configured to adjustably hold therein the second end of the belt, thereby changing a length of the belt between the connection point and the insertion part of the buckle.

9. The spa of claim 8, wherein the at least one attachment assembly comprises a first attachment assembly, a second attachment assembly, and a third attachment assembly, each of the first, second, and third attachment assemblies having an adjustable length.

10. The spa of claim 9, wherein:

the first attachment assembly connects a lower portion of the inflatable backrest to the inflatable bench;

the second attachment assembly connects a first side of a top portion of the inflatable backrest to the inflatable bench; and the third attachment assembly connects a second side of the top portion opposite the first side to the inflatable bench.

11. The spa of claim 8, wherein:

the inflatable backrest is detachably couplable, via the at least one attachment assembly to one of a first end of the inflatable bench and a second end of the inflatable bench.

12. The spa of claim 8, wherein the inflatable backrest is separately inflatable from the inflatable bench.

13. The spa of claim 8, further comprising an inflatable stool assembly attached to the floor of the pool body.

14. The spa of claim 8, further comprising an air chamber having a plurality of holes configured to release bubbles into water filling the water cavity.

15. A spa, comprising:

a pool body; and a seating assembly comprising:

an inflatable bench attached to a floor of the pool body, an inflatable backrest, and at least one attachment assembly detachably coupling the inflatable backrest to the inflatable bench, the at least one attachment assembly having an adjustable length such that a position of the inflatable backrest relative to the inflatable bench is adjustable, the at least one attachment assembly comprising:

a loop attached to the inflatable backrest;

a belt configured to pass through the loop;

a reception part of a buckle attached to a first end of the belt;

a point of connection attaching the inflatable bench to a connection point of the belt between the first end of the belt and a second end of the belt, opposite the first end; and an insertion part of the buckle comprising a slot configured to adjustably hold therein the second end of the belt, thereby changing a length of the belt between the connection point and the insertion part of the buckle.

16. The spa of claim 15, wherein the at least one attachment assembly comprises a first attachment assembly, a second attachment assembly, and a third attachment assembly, each of the first, second, and third attachment assemblies having an adjustable length.

17. The spa of claim 16, wherein:

the first attachment assembly connects a lower portion of the inflatable backrest to the inflatable bench;

the second attachment assembly connects a first side of a top portion of the inflatable backrest to the inflatable bench; and the third attachment assembly connects a second side of the top portion opposite the first side to the inflatable bench.

18. The spa of claim 15, wherein:

the inflatable backrest is detachably couplable, via the at least one attachment assembly to one of a first end of the inflatable bench and a second end of the inflatable bench.

19. The spa of claim 15, wherein the inflatable backrest is separately inflatable from the inflatable bench.

20. The spa of claim 15, further comprising an inflatable stool assembly attached to the floor of the pool body.

21. The spa of claim 15, further comprising an air chamber having a plurality of holes configured to release bubbles into water filling the water cavity.

* * * * *